US006517470B1

(12) United States Patent
Chak et al.

(10) Patent No.: US 6,517,470 B1
(45) Date of Patent: Feb. 11, 2003

(54) EXERCISING DEVICE

(76) Inventors: Mark Chak, 3250 Coney Island Ave., Apt. E2, Brooklyn, NY (US) 11235; Alexander Chak, 3250 Coney Island Ave., Apt. E2, Brooklyn, NY (US) 11235

( * ) Notice: Subject to any disclaimer, the term of this patent is extended or adjusted under 35 U.S.C. 154(b) by 0 days.

(21) Appl. No.: 09/721,883

(22) Filed: Nov. 27, 2000

(51) Int. Cl.[7] ..... A63B 21/02
(52) U.S. Cl. ..... 482/126; 482/121; 482/124
(58) Field of Search ..... 482/49, 126, 124, 482/139, 125, 91, 127, 121, 103

(56) References Cited

U.S. PATENT DOCUMENTS 4,685,671 A * 8/1987 Hagerman et al. ..... 482/124
4,762,318 A * 8/1988 Phillips et al. ..... 482/126
5,792,034 A * 8/1998 Kozlovsky ..... 482/124

* cited by examiner

*Primary Examiner*—Jerome W. Donnelly
(74) *Attorney, Agent, or Firm*—I. Zborovsky

(57) ABSTRACT

An exercising device has a belt adapted to be worn by a user, and an elastic element fixable by the belt to a user's body and having two ends graspable by a user for expanding the elastic element and exercising.

4 Claims, 1 Drawing Sheet

EXERCISING DEVICE

BACKGROUND OF THE INVENTION

The present invention generally relates to exercising devices.

There are many exercising devices which are used in special places for public and also by individual users for exercising. It is believed to be advisable to provide a mobile exercising device, which a user can easily use in any place.

SUMMARY OF THE INVENTION

Accordingly, it is an object of the present invention to provide such a mobile exercising device.

In keeping with these objects and with others which will become apparent hereinafter, one feature of present invention resides, briefly stated, in an exercising device which has a belt adapted to be worn by user; and an elastic element fixable by said belt to a user's body and having two ends graspable by a user for expanding said elastic element and exercising.

When the device is designed in accordance with the present invention, it is simple and easy to use by a user in any circumstances. The user simply attaches the device to his body by his belt which he wears, and then he or she can exercise.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figures 1, 2:
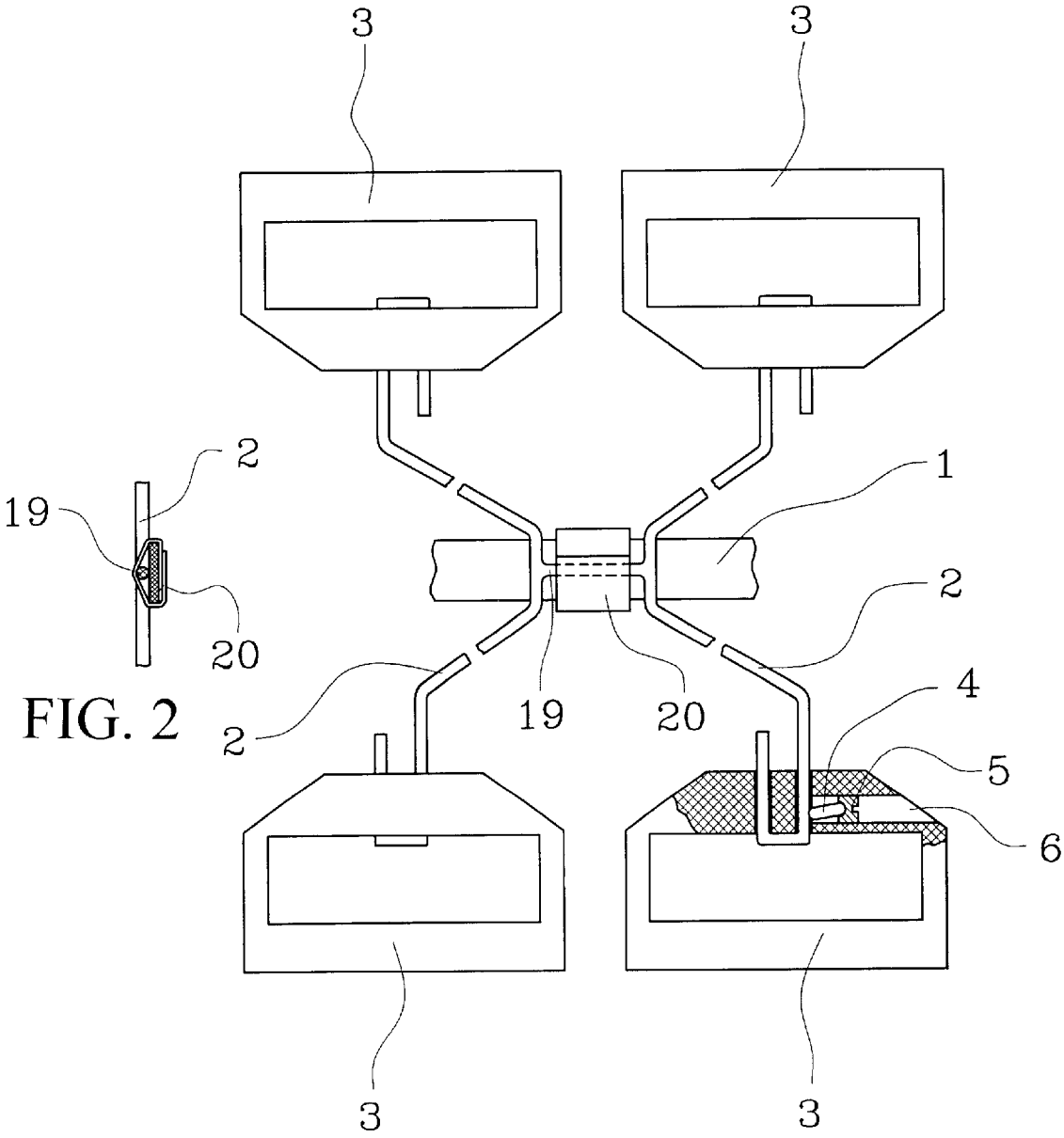
FIG. 1 is a view showing an exercising device in accordance with the present invention.
FIG. 2 is a side view of a portion of the inventive exercising device.

An exercising device in accordance with the present invention has a belt which is identified as a whole with reference numeral 1. It is formed a conventional belt and can be worn by a user on a waist. The exercising device further has two exercising elements 2. In the shown embodiment of FIG. 1, each exercising element 2 is formed as a stretchable belt.

In the embodiment of FIGS. 2*a*–2*c* the elastic element 2 is composed of a plurality of separate elastic members 2'. Each of the elastic members 2' has one end connectable to the belt in the same manner as in the embodiment of FIGS. 1*a*–1*d*, and another end provided with a handle 3. Two elastic members 2' can be used for exercising the user's arms, while two other elastic members 2' can be used for exercising the user's legs.

In the embodiment of FIGS. 3*a* and 3*b* the elastic members 2' are connected to a joint element formed for example as a plate, which can be of any material, including a soft material, and rubber, fabric, etc. The plate 7 in turn is connected with the belt 1 in the same way as in the preceding embodiments, for example by a bolt and a nut.

In accordance with a further embodiment of the present invention shown in FIGS. 4*a* and 4*b*, the belt 1 has a buckle 8 so as to adjust the belt. The elastic members 2' are connected with a loop-shaped element 9, through which the belt 1 can pass. The loop-shaped element 9 can be composed of rubber, fabric, etc.

In the embodiment of FIG. 5 two elastic elements 2' are each provided with handles at opposite ends and:placed under the belt 1 between the belt and the body of a user. Therefore, the elastic elements 2' are firmly held, and the user can stretch the elements by pulling the handles either with his arms or with his legs. An additional intermediate element 10 can be located between the elastic elements 2' and the body and formed as a patch of rubber, fabric and the like. Also, the elastic elements 2' can be formed not as wide elastic band as in the previous embodiment, but as a round rubber cord.

As can be seen from this drawing the device is provided with a braking mechanism which includes an inclined braking pad 4 and a nut 5 screwable into an opening 6 of the handle. When the nut is screwed in the opening the pad is pressed against the: belt and stops its movement. The belt can be adjusted. The pad is somewhat inclined so that the belt can be pulled through the opening to reduce its length but can not move out when the adjustment has been completed.

The elastic elements 2 extend at the right side and left side of an axis of symmetry of the belt and are connected with one another by intermediate portion 19. A sleeve 20 is wrapped around the portion 19 and its ends can be connected with another by a velcro.

FIGS. 10*a* and 10*b* shows somewhat different or blocking mechanism. The handle is provided with a conical opening, and a conical wedge-shape member 21 is insertable in the opening. The member 21 is provided with four slots extending from this upper end toward the top and ending shortly before the top so that an upper wall is formed. The belt extends through a central opening of the member 21 with a friction fit. When the belt is pulled by its free end. In FIG. 10*b*, it can be easily moved. However, the belt can not be pulled out by its right part since the wedge shape member 21 will move deeper into the opening of the handle, its segments made by the slot compress and firmly hold the member 21 and the belt in the handle.

FIG. 7 shows still a further embodiment. Here the elastic element 11 has a plurality of engaging formations 12 and an opening 13. The elastic element 1 can be wound so that its part with engaging formations 12 surrounds the belt and passes through the opening 14 so that the engaging formation does not allow the elastic element 1 to unwind and to be disconnected from the belt. The handle series for stretching the elastic element 11 as in the previous embodiment.

As shown in the drawings, the elastic element can be provided with a buckle so that a length of the elastic element can be adjusted.

It will be understood that each of the elements described above, or two or more together, may also find a useful application in other types of constructions differing from the types described above.

While the invention has been illustrated and described as embodied in exercising device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An exercising device, comprising a belt adapted to be worn by a user; two elastic elements fixable by said belt to a user's body and each having two ends graspable by a user for expanding said elastic element and exercising; four handles arranged so that each of said elastic elements connects two of said handles with one another; a connecting part connecting said elastic elements with one another; and a sleeve surrounding said connecting part and attaching it to said belt.

2. An exercising device as defined in claim 1; and further comprising braking means for braking at least one of said elastic elements in at least one of said handles after adjustment.

3. An exercising device as defined in claim 2, wherein said braking means includes a braking pad, and a nut threadingly screwable into said handle so as to push said braking element toward the elastic element and to brake it in said handle.

4. An exercising device as defined in claim 3, wherein said pad is inclined so that said belt can be pulled through said handle to adjust its length, but can not be pulled out after the adjustment.

* * * * *